US008720561B2

(12) United States Patent
Zhou

(10) Patent No.: US 8,720,561 B2
(45) Date of Patent: May 13, 2014

(54) SLIDING STAGE CEMENTING TOOL AND METHOD

(75) Inventor: Shaohua Zhou, Dhahran (SA)

(73) Assignee: Saudi Arabian Oil Company (SA)

( * ) Notice: Subject to any disclaimer, the term of this patent is extended or adjusted under 35 U.S.C. 154(b) by 321 days.

(21) Appl. No.: 13/085,187

(22) Filed: Apr. 12, 2011

(65) Prior Publication Data

US 2012/0261127 A1 Oct. 18, 2012

(51) Int. Cl.
*E21B 33/127* (2006.01)
*E21B 33/13* (2006.01)

(52) U.S. Cl.
USPC ..... 166/289; 166/187; 166/194; 166/177.4; 277/333

(58) Field of Classification Search
USPC ..... 166/187, 285, 386, 194, 191, 289, 166/177.4, 387; 277/331, 333
See application file for complete search history.

(56) References Cited

U.S. PATENT DOCUMENTS

| | | | | | |
|---|---|---|---|---|---|
| 1,944,442 | A | * | 1/1934 | Manning | 166/147 |
| 2,671,510 | A | * | 3/1954 | Slick et al. | 166/63 |
| 2,815,817 | A | * | 12/1957 | Conrad | 277/333 |
| 2,845,130 | A | * | 7/1958 | Austin | 277/333 |
| 3,527,299 | A | | 9/1970 | Lewis | |
| 3,575,238 | A | * | 4/1971 | Shillander | 166/187 |
| 4,648,448 | A | * | 3/1987 | Sanford et al. | 166/187 |
| 5,143,015 | A | * | 9/1992 | Lubitz et al. | 166/187 |
| 5,236,201 | A | * | 8/1993 | Vance et al. | 277/334 |
| 5,383,520 | A | * | 1/1995 | Tucker et al. | 166/142 |
| 5,526,878 | A | | 6/1996 | Duell | |
| 5,718,292 | A | * | 2/1998 | Heathman et al. | 166/387 |
| 5,738,171 | A | * | 4/1998 | Szarka | 166/289 |
| 5,823,273 | A | * | 10/1998 | Ravi et al. | 175/72 |
| 6,009,951 | A | | 1/2000 | Coronado et al. | |
| 6,164,378 | A | * | 12/2000 | Coronado | 166/187 |
| 6,508,305 | B1 | * | 1/2003 | Brannon et al. | 166/293 |
| 6,651,743 | B2 | * | 11/2003 | Szarka | 166/285 |
| 6,820,697 | B1 | | 11/2004 | Churchill | |
| 7,178,603 | B2 | * | 2/2007 | Naquin et al. | 166/387 |
| 7,806,192 | B2 | | 10/2010 | Foster et al. | |
| 2003/0075342 | A1 | * | 4/2003 | Gunnarsson | 166/387 |
| 2009/0084555 | A1 | | 4/2009 | Lee | |
| 2010/0163252 | A1 | | 7/2010 | De La Mothe et al. | |

OTHER PUBLICATIONS

PCT International Search Report dated Jul. 3, 2012, International Application No. PCT/US2012/033055, International Filing Date: Apr. 11, 2012.

* cited by examiner

*Primary Examiner* — Kenneth L Thompson
(74) *Attorney, Agent, or Firm* — Bracewell & Giuliani LLP; Constance Gall Rhebergen; Keith R. Derrington

(57) ABSTRACT

A downhole tool provided within a casing string for use in cement staging operations. The tool includes a sleeve in the tool that selectively slides downward under pressure to expose ports formed in a side wall of the tool. Also, an annulus through the tool is selectively blocked so that cement in the casing string flows radially outward through the ports and into an annulus between the tool and a wellbore. An inflatable packer is included that is integral to the body of the tool and is inflated with a fluid that is pushed into the packer as the sleeve slides downward. An optional expanding agent can be included in the packer that is a metal oxide and is activated with the addition of water.

17 Claims, 8 Drawing Sheets

SLIDING STAGE CEMENTING TOOL AND METHOD

BACKGROUND OF THE INVENTION

1. Field of the Invention

The present invention relates to an apparatus for use while completing a subterranean hydrocarbon producing well. More specifically, the invention relates to an apparatus for the staging of cement between casing and a wellbore.

2. Description of the Related Art

When completing a subterranean well, casing is typically inserted into the wellbore and secured in place by injecting cement within the casing. The cement is then forced through a lower end of the casing and into an annulus between the casing and wellbore wall. A wiper plug is typically used for pushing the cement from the casing. A displacement fluid, such as water, or an appropriately weighted mud is pumped into the casing above the plug, the pressurized fluid serves as a motive force to urge the plug downward through the casing to extrude the cement from the casing outlet and back up into the annulus. However, as wells are increasingly being drilled deeper, the hydraulics for cementing the casing wellbore annulus in a substantially deep well makes the single stage cement injection process impracticable. Also, in some instances it is impossible to cement the entire well. For example, cement is not provided in portions of the well, where the well formation pressure is less than well hydrostatic pressure, or where the formation is too porous so high cement slurry pressure in the case induces formation breakdown, which leads to losses in the formation, as a result, no cement is present.

To overcome the problems of a single stage cement process, the casing string is cemented in sections, which is known as a staging process. Staging involves placing cement staging tools integral within the casing string; the staging tools allow cement to flow downward therethrough to a lower section of the casing string during primary or first stage cementing operations. When the portion of the casing string below the particular staging tool is cemented to the well, the staging tool selectively closes its bore and opens a side port to divert cement into the surrounding annulus where the cement can flow upwards in the annulus. The cement staging tools also are equipped with packers for sealing the annular area between the tool and wellbore. However, presently known tools experience failures such as failure to inflate the packer element, failure to open ports, failure to close ports, and disconnection of the tool from the casing string.

SUMMARY OF THE INVENTION

The present disclosure discloses a downhole tool and method of use in completing a wellbore. In an example embodiment, the downhole tool is made up of a tubular body integrally formed within a casing string where a port is formed through a wall of the tubular body. An inflatable packer is included that circumscribes a portion of the tubular body and an annular cylinder is provided in the tubular body that is in fluid communication with the packer. A sleeve is set coaxially within the tubular body and selectively changeable between a pass through and by-pass configuration. When in the pass through configuration the sleeve defines a flow barrier between an annulus of the tubular body and the port. When in the sleeve is in the by-pass configuration, the annulus of the tubular body is in fluid communication with the port and having a portion of the sleeve inserted into the cylinder. Also included is a fluid disposed in the cylinder and remains in the cylinder when the sleeve is set in the pass through configuration and is pushed into the packer when the sleeve is in the by-pass configuration for inflating the packer. Optionally, a reactive compound is provided in the packer for selectively expanding the packer. In an embodiment, the reactive compound comprises a metal oxide. In an embodiment, the metal oxide comprises calcium oxide. Alternatively, included is a ball seat disposed in the sleeve, in this example embodiment the ball seat has a profiled shoulder configured for receiving a ball therein. A sealing interface may be formed along where the ball contacts the shoulder, so that when a force is applied to the ball to urge the ball against the shoulder, the sleeve is moved into the by-pass configuration. In yet another alternative embodiment, a spring may be engaged with the sleeve, where the spring becomes compressed as the sleeve is moved into the by-pass configuration, so that when the force applied to the ball is removed, the spring returns to an uncompressed state and moves the sleeve to the pass through configuration. In an alternative, the fluid is selectively pressurized on an upper surface of the ball to generate the force applied to the ball.

Also disclosed herein is a method of cementing a portion of a downhole tubular in a wellbore. In an example embodiment, a stage cementing tool is included with the tubular, where the stage cementing tool is made up of a tubular body having a passage formed through a sidewall of the tubular body. Included with the stage cementing tool is an inflatable packer that circumscribes a portion of the tubular body. Also included is a sleeve that can slide within the tubular body and fluid that is in communication with the sleeve and the packer. The method further includes simultaneously inflating the packer and flowing cement from within the tubular into an annulus between the tubular and the wellbore. Cement is diverted from the side of the tool by urging the sleeve axially within the tubular body from a position that blocks flow through the passage to a position allowing flow through the passage and along a path that forces the fluid into the packer. Optionally, the stage cementing tool further comprises an expanding agent in the packer, the method further comprising selectively activating the expanding agent for inflating the packer. In an alternative embodiment, the expanding agent includes a metal oxide. Optionally, selectively activating the expanding agent can involve introducing moisture to the expanding agent. In an example embodiment, the packer expands radially outward from the stage cementing tool and forms a sealing interface with a wall of the wellbore. In one example embodiment, the stage cementing tool is a first stage cementing tool and the method further involves repeating the above steps of inflating the packer and flowing cement from within the tubular into an annulus between the tubular and the wellbore and at a depth above the first stage cement tool. Optionally, cement introduced into the annulus at each stage cementing tool flows in the annulus downward where is supported on a lower end by a packer to wellbore interface formed at a lower adjacent stage cementing tool.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
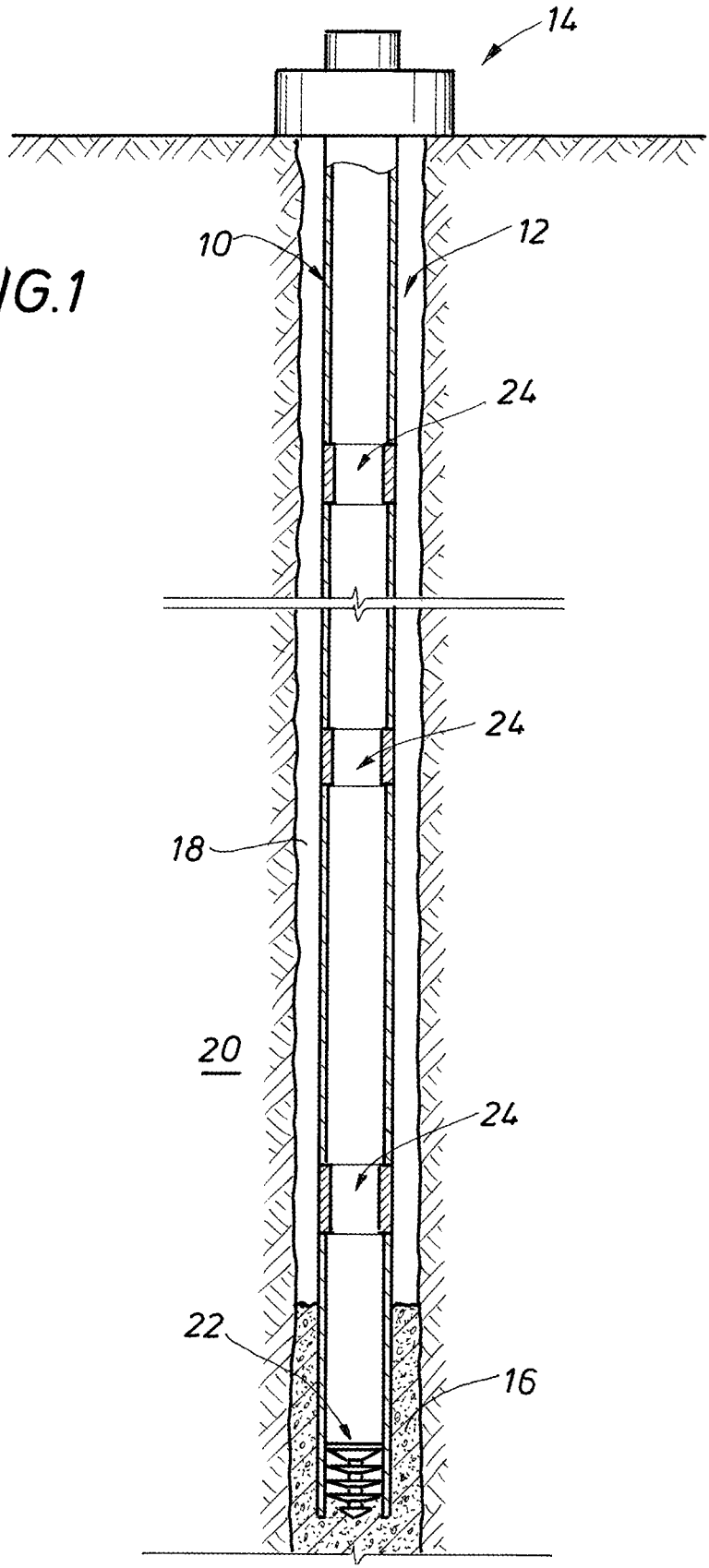
FIG. 1 is a side sectional view of an example of a stage cementing tool in a casing string in accordance with the present invention.

Shown in side sectional view in FIG. 1 is an example of a string of casing 10 set in a wellbore 12. The casing 10 is shown supported on its upper end by a wellhead assembly 14 disposed at the entrance to the wellbore 12 on the surface. In the embodiment of FIG. 1, cement 16 is shown being inserted into an annulus 18 formed between the casing 10 and walls of the wellbore 12. The cement 16 secures the casing 10 to the formation 20 that circumscribes the wellbore 12. The cement 16 may be injected into the casing 10 via the wellhead assembly 14, a plug 22 can be inserted into the casing 10 above the cement 16. Pressure applied to the upper end of the plug 22 urges the plug and cement 16 through and out of the bottom of the casing 10. After exiting the casing 10, the cement 16 flows into the lower end of the annulus 18 and upwards within the annulus 18. How far up the annulus 18 the cement 16 flows is dictated by the pressure at the bottom end of the casing 10. To overcome the high static pressures faced when cementing deep wellbores, cementing may require multiple stages at various depths along the casing to limit the amount of pressure applied into the casing 10 from the surface. To accomplish a staging process, an example embodiments of staging tools 24 are shown included at locations within the string of casing 10. In the embodiment of FIG. 1, the upper level of the cement 16, in the initial cementing step, is generally maintained at a depth below the staging tool 24.

Figure 2:
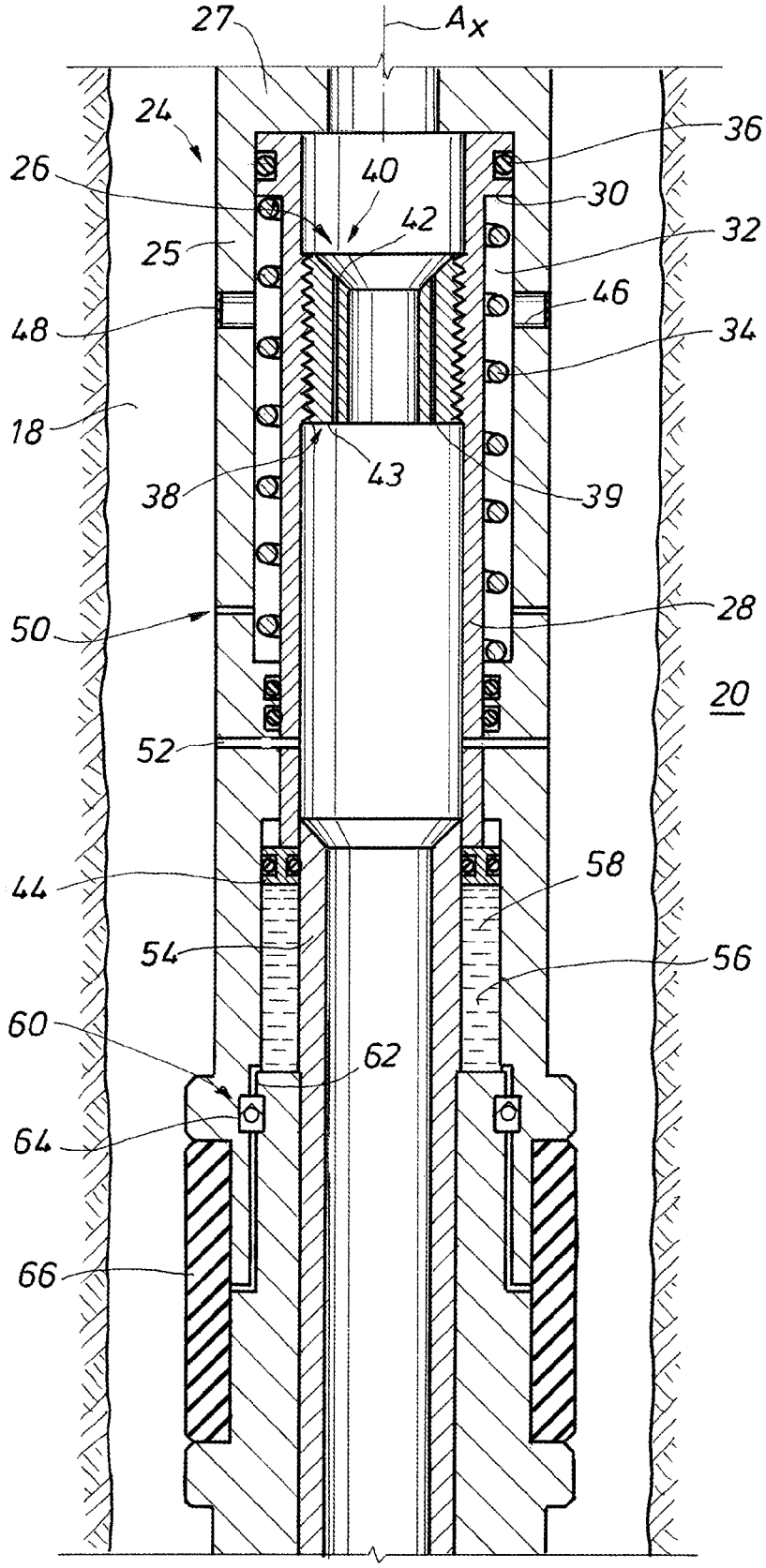
FIG. 2 is a side sectional view of an example of the stage cementing tool of FIG. 1 in a pass through configuration in accordance with the present invention.

Referring now to FIG. 2, a side sectional view of an example embodiment of the staging tool 24 of FIG. 1 is shown in more detail. In the example of FIG. 2, the staging tool 24 is illustrated as a generally annular device having an annular body 25 with a tubular piston assembly 26 inserted within the body 25. On an upper end of the body 25 is a lip 27 that extends radially inward towards an axis $A_X$ of the staging tool 24. The piston assembly 26 has a piston body 28 shown generally coaxial with the body 25 also having a lip 30 on its upper end. Unlike the inwardly extending lip 27, the lip 30 of the piston body 28 extends radially outward from the upper end of the body 28. In the configuration of FIG. 2, the lip 30 is shown axially urged against a lower surface of the lip 27 on the staging tool body 25. As the piston body 28 extends axially in a direction away from the lip 30 and in line with the inner circumference with the lip 30, an annular space 32 is shown defined by the region bounded on its lateral sides by the outer circumference of the body 28 and the inner circumference of the tool body 25. The upper end of the annular space 32 is defined by a portion of the lower surface of the lip 30. A coiled spring 34 is shown set within the annular space 32 and, as will be described in more detail below, the spring 32 is selectively compressed and provides a restoring force for maintaining the piston body 28 in the configuration of FIG. 2. Optional O-ring seals 36 are shown on an outer circumference of the lip 30 that form a sealing interface between the piston assembly 26 and inner circumference of the tool body 25.

An annular ball seat 38 is shown coupled to the inner circumference of the piston body 28 and depending radially inward towards the axis $A_X$. A threaded connection 39 may be used for coupling the ball seat 38 with the piston body 28. An upwardly facing lateral surface of the ball seat 38 is shown having a profile that defines an upper face 40, wherein the upper face slopes downward and away from the lip 27 with distance away from the piston body 28 and approaching the axis $A_X$. Also optionally, an axial vent 42 is shown formed through the body of the ball seat 38 thereby providing pressure communication from the upper face 40 and lower surface 43 of the ball seat 38. Shown on an axial end of the piston assembly 26 opposite the lip 30 is a ring-like piston head 44 having optional O-ring seals on its inner and outer circumference. Radial ports 46 are further illustrated that are formed through a side wall of the body 25 and a location adjacent the annular space 32. As such, when the staging tool 24 is in the pass-through configuration of FIG. 2, the piston assembly 26, through its piston body 28, O-ring seals 36, and O-ring seals around the piston head 44, defines a flow barrier between the annulus 18 and inner confines of the staging tool 24. Accordingly, in the example configuration of FIG. 2, cement can flow through the string of casing 10 and the staging tool 24 to a lower depth as illustrated in FIG. 1.

Optional screen filters 48 may be provided as shown within the circulating ports 46. The presence of the screen filters 48 may shield debris and other desired matter from entering the ports 46. An optional radial vent 50 is further illustrated through the side wall of the body 25 and between the outer circumference of the body 25 and into the annular space 32. As indicated above, the force of the spring 34 may exert a force on the piston assembly 26 that urges the lip 36 up against a lower surface of the lip 27 of the body 25. Shear pins 52 are shown inserted into a passage in the body 25 and a passage (shown registered with the passage in the body 25) depending radially inward from an outer surface on the piston body 28.

A sleeve 54 is further illustrated that depends coaxially from a lower end of the piston body 28 and downward within a lower portion of the staging tool 24. The radial inward position of the sleeve 54 as well as an annular channel formed on an inner surface of the body 25 define an annular cylinder 56 that is disposed between the sleeve 54 and body 25. The upper end of the cylinder 56 is defined by lower surface of the piston head 44. In the embodiment of FIG. 2, a fluid 58 is shown provided within the annular cylinder 56. A fluid circuit 60, shown extending through the body 25, is made up of a flow line 62 with an integral check valve 64. In one example embodiment, the check valve 64 allows flow away from the cylinder 56 but prevents flow from returning the cylinder 56 across the check valve 64. The end of the fluid circuit 60 opposite where it communicates with the cylinder 56 is shown communicating with an inner circumference of an inflatable packer 66. The inflatable packer 66 circumscribes a portion of the outer surface of the body 25.

Figure 3:
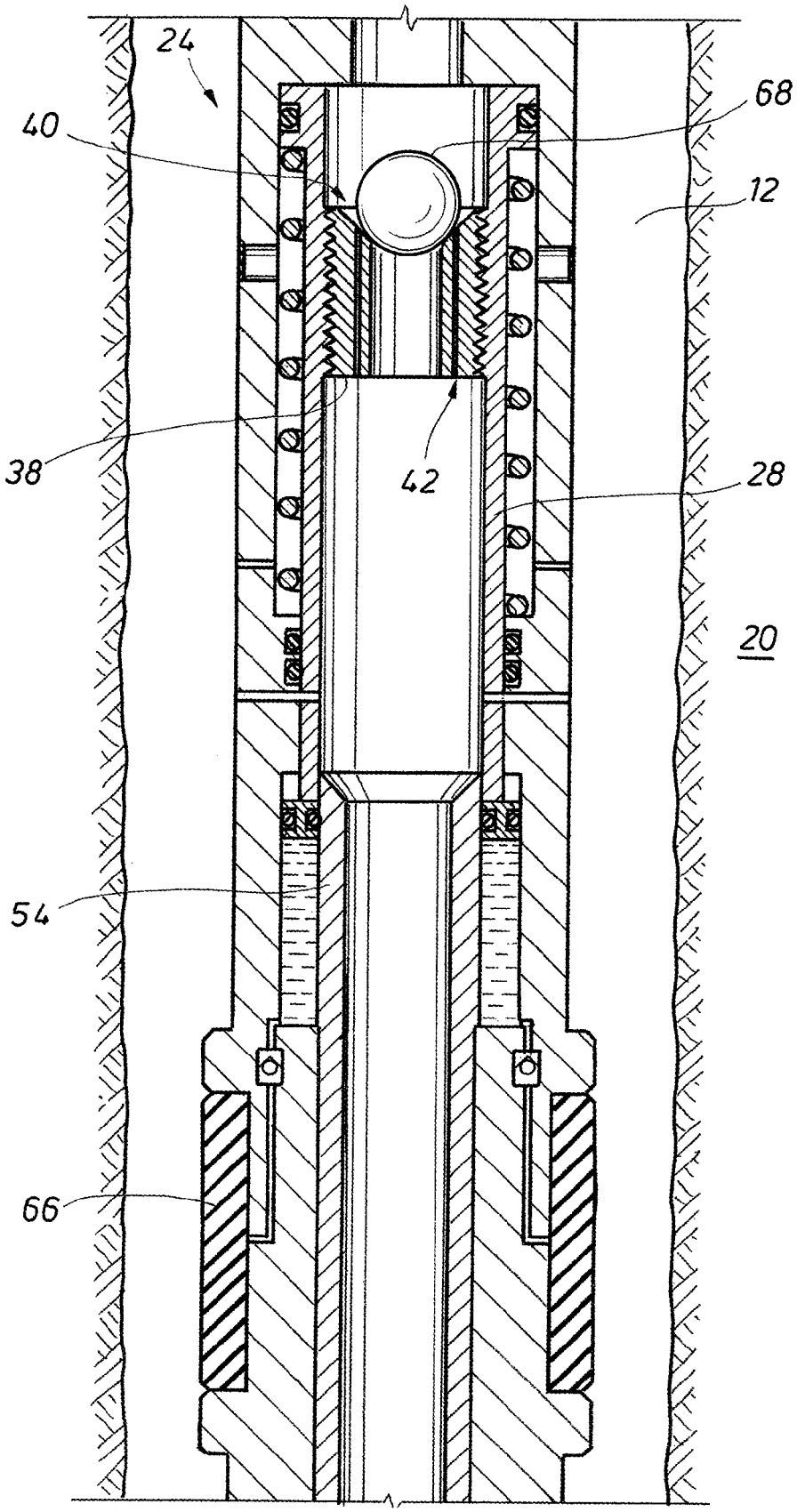
FIG. 3 is a side sectional view of an example of the stage cementing tool of FIG. 2 having a sealing member landing within in accordance with the present invention.
Figure 4:
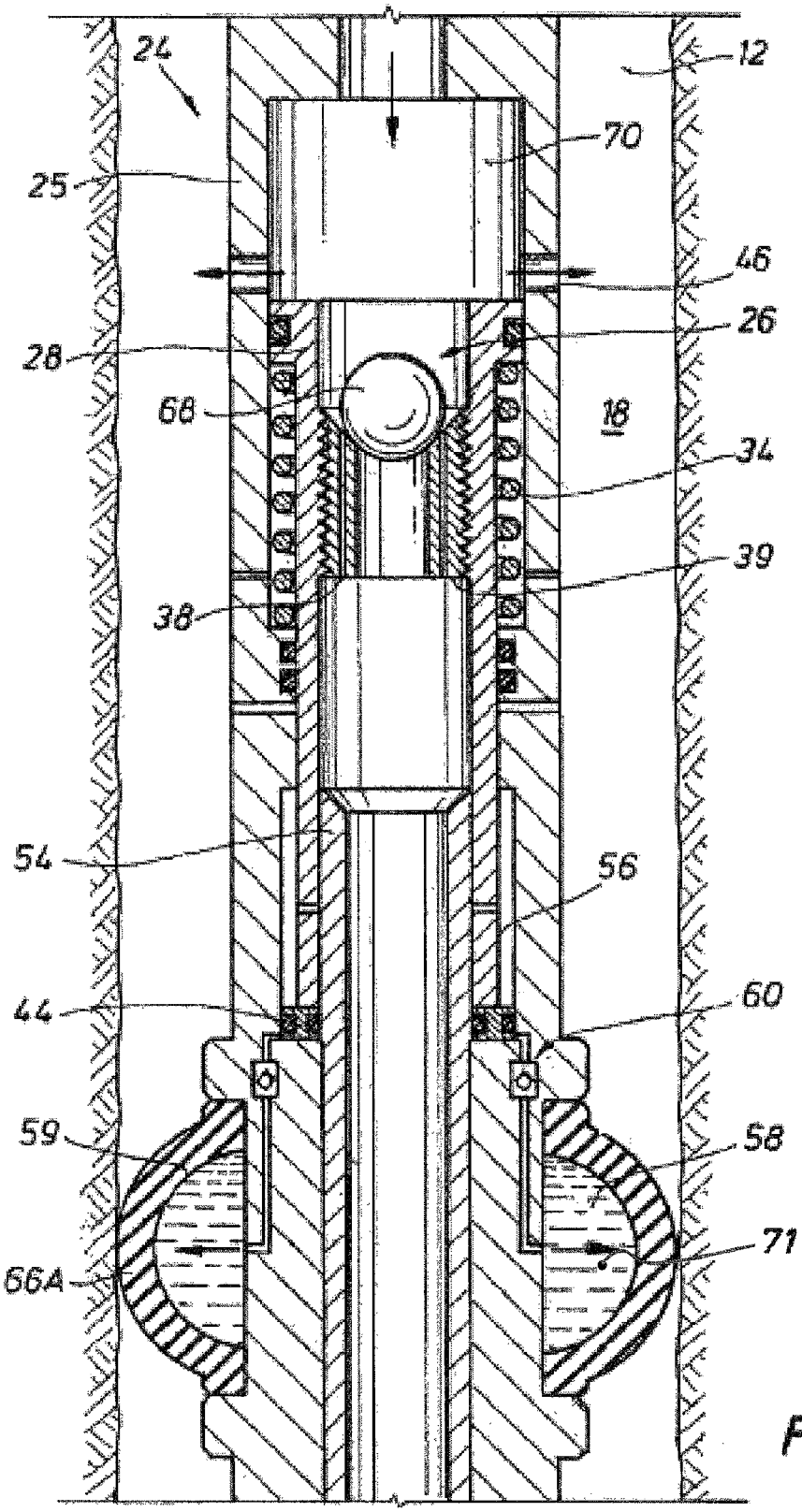
FIG. 4 is a side sectional view of an example of the stage cementing tool of FIG. 3 with an applied annulus pressure packers being inflated in accordance with the present invention.

Referring now to FIG. 3, an example embodiment of the staging tool 24 is shown wherein a ball 68 has been dropped within the wellbore 12 and landed on the upper shoulder 40. The ball 68 defines a pressure seal along the interface of contact between the ball 68 and upper surface 40 of the ball seat 48. It should be pointed out however, that the dimensions of the ball 68 are such that the vent 42 remains in communication with the portions of the wellbore 12 above the ball 68. As shown in FIG. 4, the annulus 70 may be pressurized in to generate a downward force, as represented by the arrow, on the upper surface of the ball 68 that is transferred to the ball seat 38. The transferred force on the ball seat 38 in turn downwardly urges the piston body 28 and compresses the spring 34. Continued application of downward force moves the upper end of the piston body 28 below the ports 46, thereby allowing fluid communication between the annulus 70 and annulus 18.

Also illustrated in FIG. 4, the piston head 44 has been pushed downward by the downward movement of the piston body 28 and through the cylinder 56 to urge the fluid 58 in the space between the packer 66A and body 25 to inflate the packer 66A so that it forms a seal between the staging tool 24 and wall of the wellbore 12. In an optional embodiment, an expandable agent 71 may be included in the space between the packer 66 and body 25 that can be activated and expand in a non-explosive manner. Example embodiments of the expandable agent include metal oxides or metalloid oxides, wherein examples are silicone dioxide, aluminum oxide, farek oxide, calcium oxide, and combinations thereof. The agent may be obtained from KMK Regulatory Services Inc., 1-888-447-7769. Further examples have the tradename Crack-a-Might®, Dexpan® and Split-AG®. As such, the packer 66 may be expanded and set by application of a downward force resulting from pressure applied in the wellbore 12.

Figure 5:
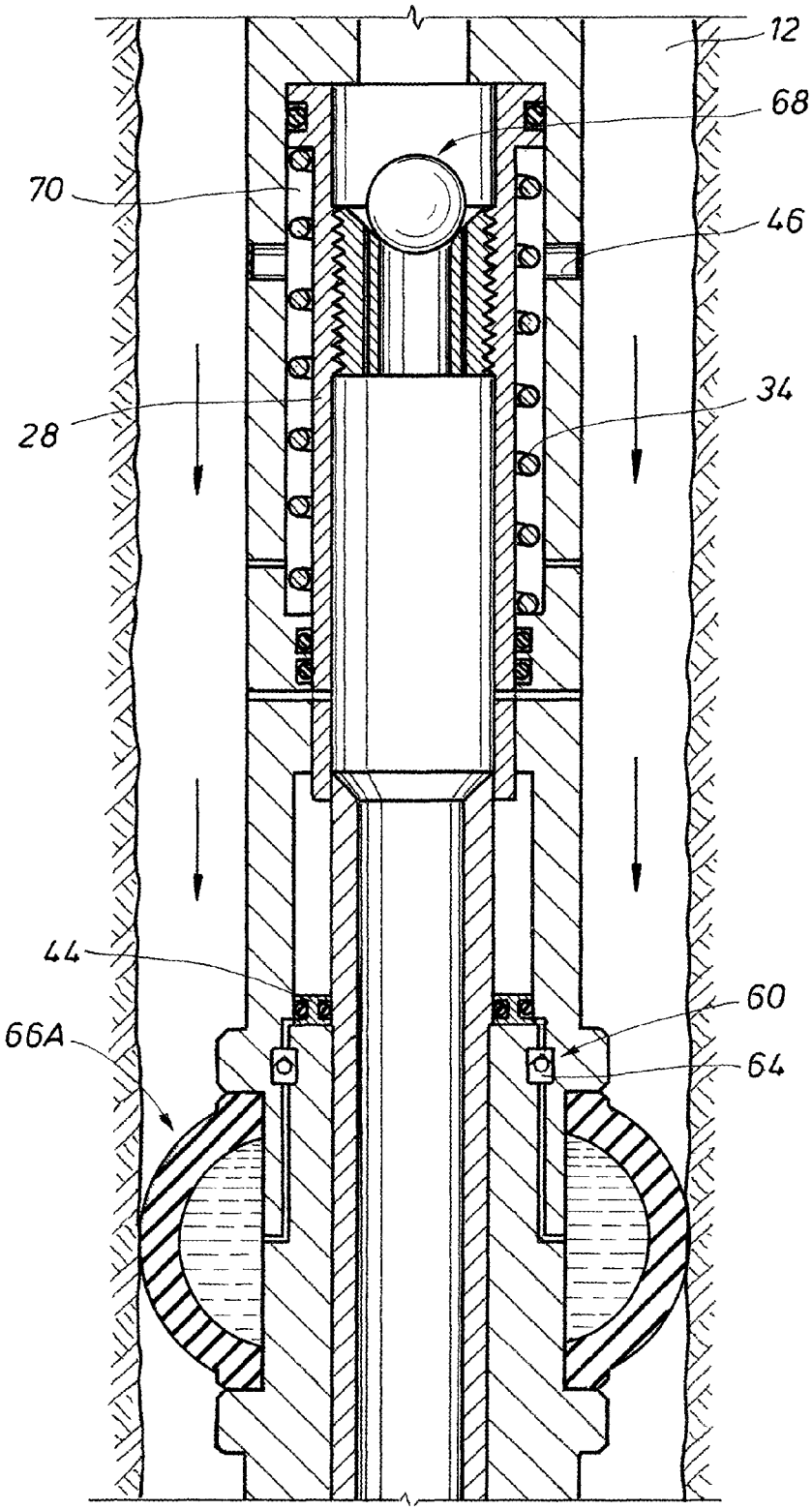
FIG. 5 is a side sectional view of an example of the stage cementing tool of FIG. 4 with a reduction in annulus pressure and with packers remaining inflated in accordance with the present invention.

In the example of FIG. 5, the pressure within the annulus 70 has been reduced from that of FIG. 4. This in turn reduces the force on the ball 68 to a level allowing the spring 34 to return to its uncompressed state and urge the piston body 28 so that the ports 46 are sealed from the confines of the casing string 10. Because the check valve 64 retains the fluid within the packer 66A, the sealing interface between the staging tool 24 and wall of the wellbore 12 is maintained, even with reduction or removal of the downward force applied to the ball 68.

Figure 6:
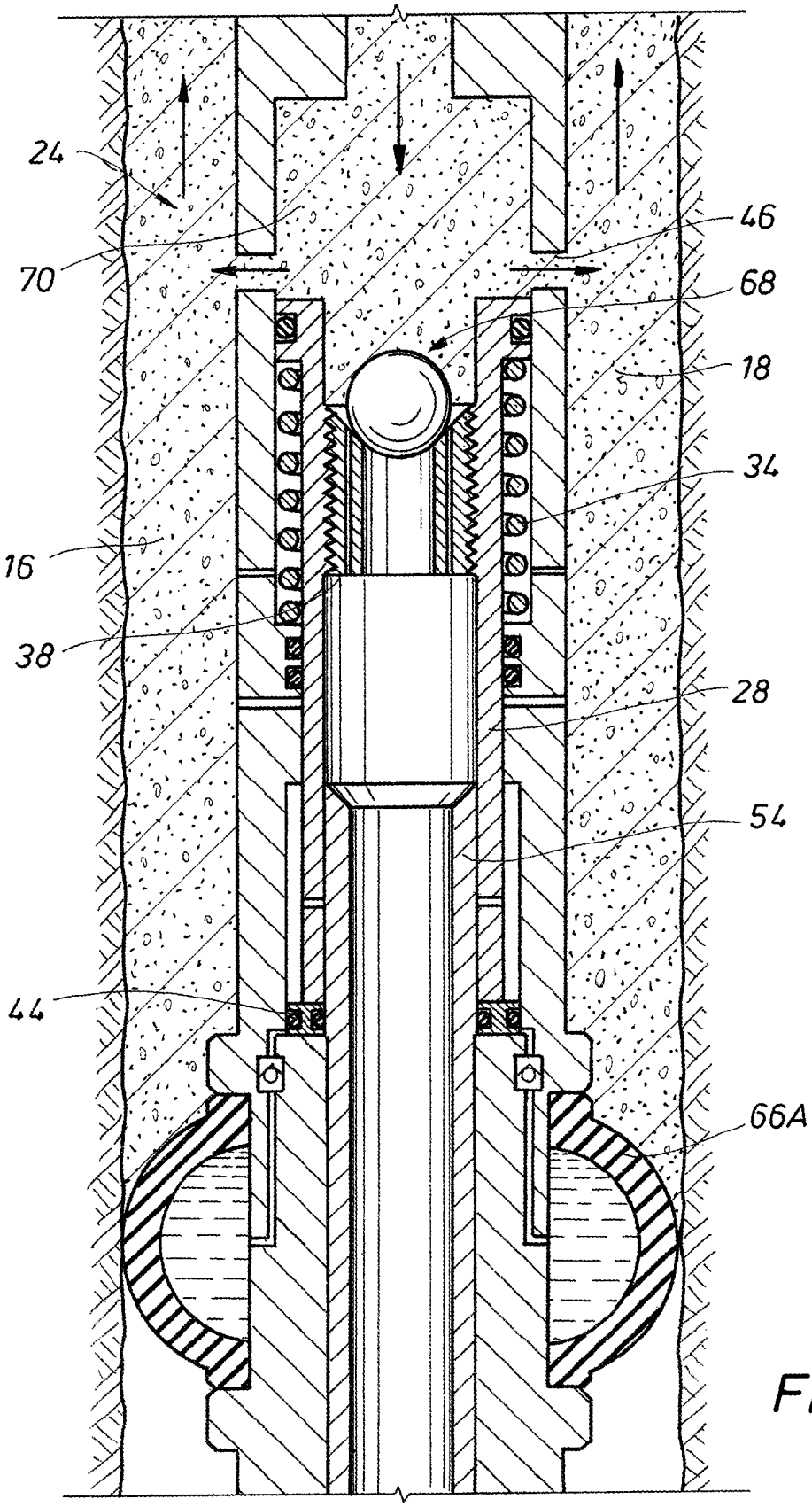
FIG. 6 is a side sectional view of an example of the stage cementing tool of FIG. 5 being positioned into a by-pass configuration and diverting cement into an annulus in accordance with the present invention.

Referring now to FIG. 6, the annulus 70 is again pressurized to apply a downward force onto the ball 68 thereby opening ports 46. Cement 16 may then be pumped into the annulus 70 where it flows through the staging tool 24 and is bypassed outward through the ports 46 and into the annulus 18 for securing the casing string 10 to the wall of the wellbore 12. As such, any cement flowing down the wellbore 12 and into the annulus 70 may exit the staging tool 24 via the ports 46 for application of cement into the space between the casing string 10 (FIG. 1) and wellbore wall for securing the casing string within the wellbore 12. The flow of cement 16 also fills the space below the ports 46 and downward to the packer 66A. As such, the cement 16 fills the space from the packer 66A and upwards either to surface or to the next adjacently positioned staging tool 24.

Figure 7:
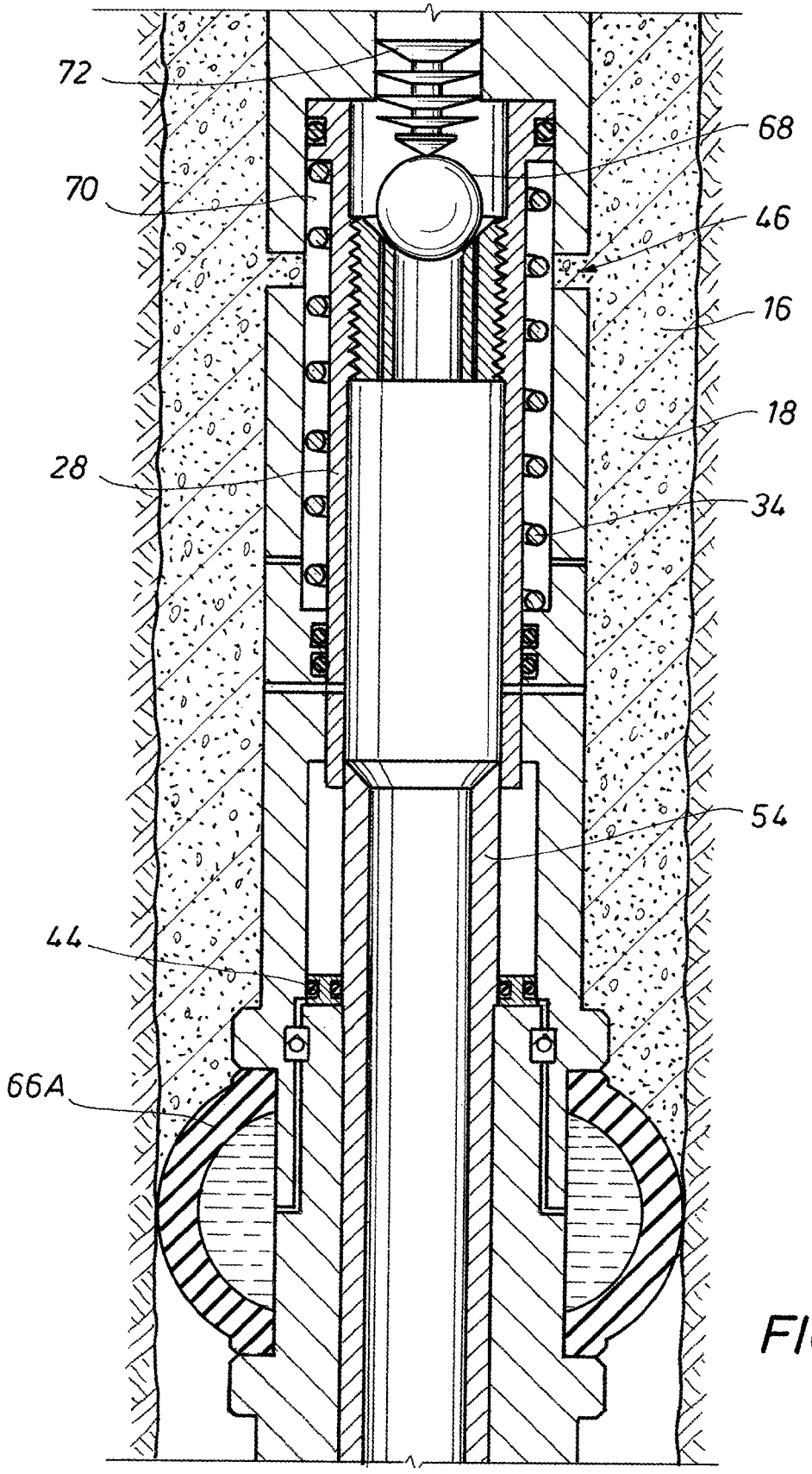
FIG. 7 is a side sectional view of an example of the stage cementing tool of FIG. 6 with a cement wiping plug landed on the ball in accordance with the present invention.

Once the annulus 18 is cemented by use of the staging tool 24, the pressure may be reduced within the annulus 70, so that the spring 34 may return the piston assembly 26 in the configuration of FIG. 7 and so that the body of the piston 28 blocks flow between the annulus 70 and to the ports 46. In this embodiment of FIG. 7, a plug 72 is shown landed on top of the ball 68. Thus, the cement in the annulus 70 above the ball 68 may be removed and urged lower and out through the ports 46.

Figure 8:
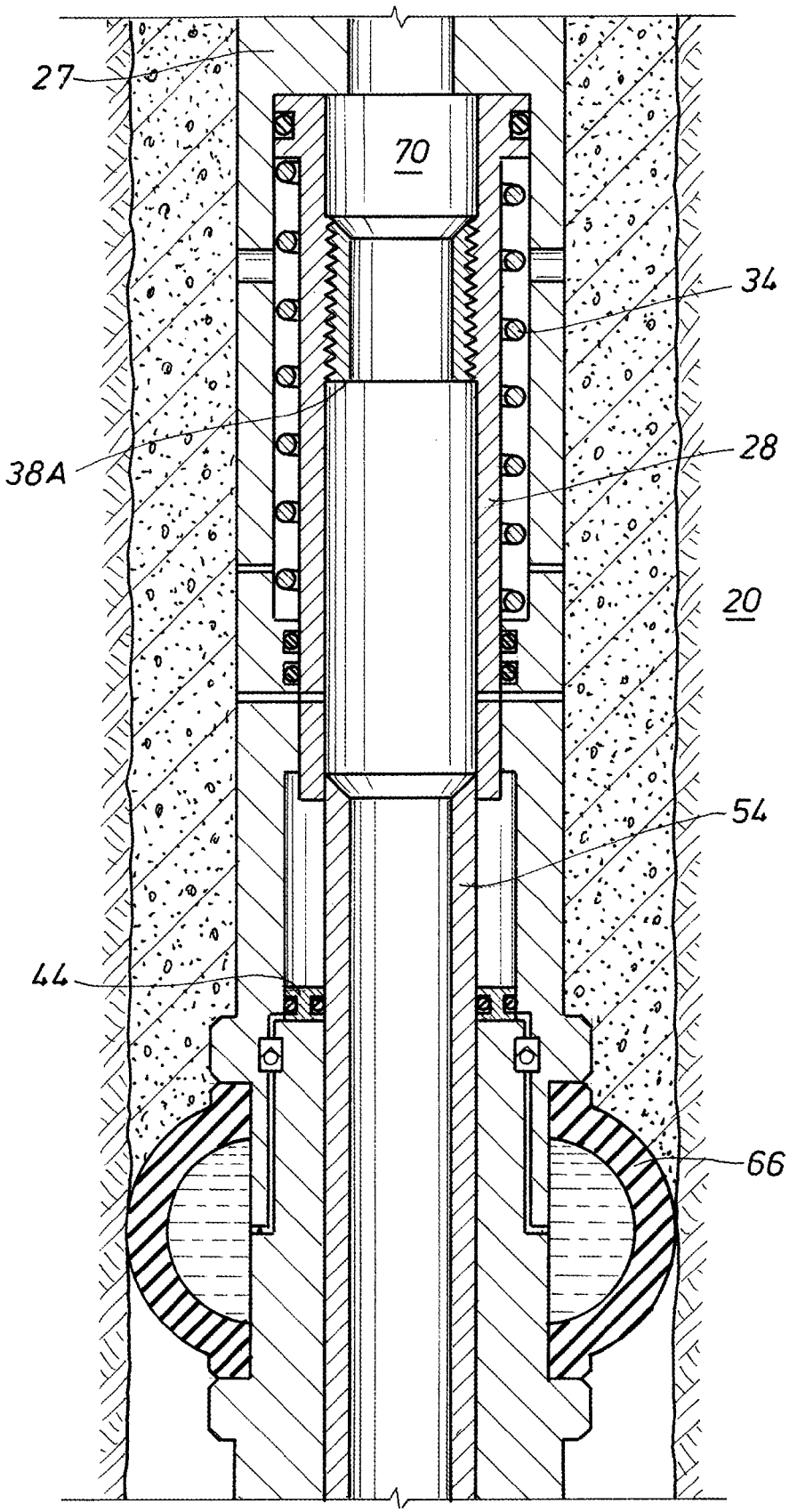
FIG. 8 is a side sectional view of an example of the stage cementing tool of FIG. 7 with the plug, ball, and portion of the stage cementing tool drilled away in accordance with the present invention.

Referring now to FIG. 8, an example embodiment of the portion of the casing string 10 having the staging tool 24 is shown after the plug 72 and ball 68 have been removed with a drill bit, or other subterranean excavating device. Thus, in this example, cement 16 is filling the annulus 18 thereby securing the portion of the casing as shown. One of the advantages of the present embodiment is that pressure integrity in the casing below the tool is not required in order for the above-described steps to take place. Moreover, a single spring-loaded piston may be employed to not only provide fluid communication from within the casing string into the annulus between the string and the formation, but may also be used for the step of inflating the packers and sealing in the space between the staging tool and wellbore. Also, the implementation of the spring 34 means that the plug 72 may be used for wiping cement from the casing and is not required to close ports within the staging tool as is required in prior art references.

Having described the invention above, various modifications of the techniques, procedures, materials, and equipment will be apparent to those skilled in the art. While various embodiments have been shown and described, various modifications and substitutions may be made thereto. Accordingly, it is to be understood that the present invention has been described by way of illustration(s) and not limitation. It is intended that all such variations within the scope and spirit of the invention be included within the scope of the appended claims.

What is claimed is:

1. A downhole tool for use in completing a wellbore comprising:

a tubular body having opposing ends that selectively couple to upper and lower sections of a casing string, so that the body is coaxial to and in fluid communication with the casing string;

a passage formed through a wall of the tubular body;

an inflatable packer circumscribing a portion of the tubular body;

an annular chamber formed within the tubular body and in fluid communication with the packer;

a sleeve coaxially within the tubular body selectively set in a pass through configuration and defining a flow barrier between an annulus of the tubular body and the port and selectively slideable into a by-pass configuration with the annulus of the tubular body in fluid communication with the port and having a portion of the sleeve inserted into the annular chamber; and fluid that is in the annular chamber when the sleeve is set in the pass through configuration and urged into the packer when the sleeve is in the by-pass configuration.

2. The downhole tool of claim 1, further comprising a reactive compound in the packer, that is reactive with moisture, selectively expanding the packer.

3. The downhole tool of claim 2, wherein the reactive compound comprises a metal oxide.

4. The downhole tool of claim 3, wherein the metal oxide comprises calcium oxide.

5. The downhole tool of claim 1, further comprising a ball seat disposed in an end of the sleeve distal from the passage, the ball seat having a profiled shoulder configured for receiving a ball therein that defines a sealing interface along where the ball contacts the shoulder, so that when a force is applied to the ball to urge the ball against the shoulder, the sleeve is moved into the by-pass configuration.

6. The downhole tool of claim 5, further comprising a spring engaged with the sleeve that is compressed as the sleeve is moved into the bypass configuration, so that when the force applied to the ball is removed, the spring returns to an uncompressed state and moves the sleeve to the pass through configuration.

7. The downhole tool of claim 5, wherein fluid is selectively pressurized on an upper surface of the ball to generate the force applied to the ball.

8. A method of cementing a portion of a downhole tubular in a wellbore comprising:

(a) providing a stage cementing tool with the tubular, the stage cementing tool comprising: a tubular body having a passage formed through a sidewall of the tubular body, an inflatable packer circumscribing a portion of the tubular body, a sleeve slideably within the tubular body, and fluid in a chamber that is in communication with the sleeve and the packer; and (b) simultaneously inflating the packer and flowing cement from within the tubular into an annulus between the tubular and the wellbore by urging the sleeve axially within the tubular body from a position that blocks flow through the passage to a position allowing flow through the passage and into the chamber so that the fluid is forced into the packer.

9. The method of claim 8, wherein the stage cementing tool further comprises an expanding agent in the packer, the method further comprising inflating the packer by selectively activating the expanding agent with moisture.

10. The method of claim 9, wherein the expanding agent comprises a metal oxide.

11. The method of claim 9, wherein the step of selectively activating the expanding agent comprises introducing moisture to the expanding agent.

12. The method of claim 8, wherein the packer expands radially outward from the stage cementing tool and forms a sealing interface with a wall of the wellbore.

13. The method of claim 8, wherein the stage cementing tool comprises a first stage cement tool, the method further comprising repeating steps (a) and (b) at a depth above the first stage cement tool.

14. The method of claim 13, further comprising providing a plurality of additional stage cement tools, wherein cement introduced into the annulus at each stage cementing tool flows in the annulus downward where each stage cementing tool is supported on a lower end by a packer to wellbore interface formed at a lower adjacent stage cementing tool.

15. A stage cementing tool comprising:

a tubular body inserted within a casing string;

an annular piston body disposed coaxially within the tubular body;

a ball seat on an end of the piston body;

an annular chamber coaxially formed within a sidewall of the tubular body;

a packer circumscribing a portion of the tubular body;

a passage having opposing ends respectively in fluid communication with the annular chamber and an inner surface of the packer and that extends through a sidewall of the tubular body; and an annular piston head that is axially slideable within the annular chamber and that is in contact with an end of the piston body distal from the ball seat, so that when the annular piston body is urged against the piston head, fluid retained in the annular chamber is urged against the inner surface of the packer and inflates the packer.

16. The stage cementing tool of claim 15, further comprising a circulating port formed radially through a sidewall of the tubular body and adjacent the piston body when the piston body is in a flow through position, and wherein when the piston body is moved axially within the tubular body to a bypass position, the circulating port provides fluid communication across the sidewall of the tubular body.

17. The stage cementing tool of claim 15, wherein fluid in the annular chamber is isolated from cement that is introduced into an annulus of the tubular body.

* * * * *